US008607719B1

(12) United States Patent
Kuzni

(10) Patent No.: US 8,607,719 B1
(45) Date of Patent: Dec. 17, 2013

(54) FEED REGULATOR FOR THERMOSTATIC CONTROL

(76) Inventor: George Kuzni, Hayward, CA (US)

( * ) Notice: Subject to any disclaimer, the term of this patent is extended or adjusted under 35 U.S.C. 154(b) by 591 days.

(21) Appl. No.: 12/772,612

(22) Filed: May 3, 2010

Related U.S. Application Data

(60) Provisional application No. 61/174,574, filed on May 1, 2009.

(51) Int. Cl.
*F23N 5/02* (2006.01)
*F23H 7/06* (2006.01)
*F23H 17/00* (2006.01)

(52) U.S. Cl.
USPC ..... 110/281; 110/185; 110/255; 110/328

(58) Field of Classification Search
USPC ..... 110/186, 190, 347, 110, 108, 281, 282, 110/283, 284, 109
See application file for complete search history.

(56) References Cited

U.S. PATENT DOCUMENTS 1,694,290 A * 12/1928 St Clair ..... 110/267
1,738,409 A * 12/1929 Weingartner ..... 74/579 R
2,907,345 A * 10/1959 Randall ..... 137/565.14
2,932,264 A * 4/1960 Hurst ..... 110/190
3,667,627 A * 6/1972 Martin et al. ..... 414/198
3,941,349 A * 3/1976 Pierson ..... 251/100
4,046,318 A * 9/1977 Ripley ..... 236/1 G
4,181,104 A * 1/1980 Shinoda ..... 123/339.24
4,194,488 A * 3/1980 Bellaff ..... 126/112
4,290,552 A * 9/1981 Prikkel, III ..... 236/1 G
4,537,140 A * 8/1985 Baker ..... 110/281
4,662,290 A * 5/1987 Potts ..... 110/109
4,771,255 A * 9/1988 Shull et al. ..... 335/253
2011/0226080 A1* 9/2011 Ieda et al. ..... 74/473.36
2011/0300494 A1* 12/2011 Masen et al. ..... 431/12

* cited by examiner

*Primary Examiner* — Kenneth Rinehart
*Assistant Examiner* — David J Laux
(74) *Attorney, Agent, or Firm* — Clinton H. Wilkinson; Charles A. Wilkinson

(57) ABSTRACT

The effective length of a control arm having manually alterable stops repositionable along is rendered automatically changeable by means of a solenoid movable strip arranged to be either pressed against the control arm or removed from contact with the control arm by operation of the automatically operated solenoid which may usually be operated by a change in the surrounding ambient temperature.

12 Claims, 13 Drawing Sheets

FEED REGULATOR FOR THERMOSTATIC CONTROL

CROSS-REFERENCE TO RELATED APPLICATIONS

The present utility application takes priority from U.S. Provisional Application Ser. No. 61/174,574 entitled, "Feed Regulator For Thermostatic Control" filed on May 1, 2009 in the name of George Kuzni.

BACKGROUND OF THE INVENTION

1. Field of the Invention

The present invention is directed to furnace and boiler stoker devices, and more particularly to an improved coal feed mechanism and control system for automatically regulating the amount of a fuel such as coal being fed to a furnace fire bed.

2. Preliminary Discussion and Discussion of Prior Art

With the price of fuels such as oil and gas continuing to rise, stoves and furnaces that use other less expensive fuels such as coal are becoming increasingly popular. Most coal stoves and furnaces include some type of stoker device or system for automatically feeding coal into the stove or furnace as needed. One such prior art device is described in U.S. Pat. No. 4,537,140 issued to Baker entitled "Automatic Coal Stove Stoker". FIG. 1 is a sectional view of the prior art Baker mechanical coal feeding mechanism, and shows a fire box in communication with a coal hopper in a usual manner, with the hopper floor sloping downwardly toward the fire box where it abuts against a similarly angled downwardly sloping perforated fire grate, so that coal in the hopper is caused by the force of gravity to slide or roll down the hopper floor through a restricted exit passage in the hopper onto the grate. In addition, as part of Baker's coal feed mechanism a linearly reciprocating slidable plate is provided on the floor of the coal hopper, which aids in advancing coal out of the hopper onto the grate. In effect, the reciprocating motion of the plate on the hopper floor in Baker enhances the gravity flow of coal out of the hopper. Such plate is operably connected to a motor via an eccentric movement means and a rod that extends through an aperture in a downwardly depending shoulder on the upper edge of the plate, which shoulder serves as a pusher bar. An end stop and a threadably adjustable stop are strategically positioned on the rod on opposite sides of the shoulder, so that movement of the rod by the eccentric movement means cause the plate to essentially be pushed back and forth in a reciprocating linear path on the hopper floor as the stops on the rod alternatingly engage against either the outer and inner sides of plate, respectively, with a pause in sliding movement for the duration of rod movement between the two stops. As the plate is urged rearwardly by the inner stop, coal in the hopper falls downwardly onto the floor of the grate into the space vacated by the front of the plate, so that when the plate is moved forwardly again the leading edge of the plate pushes or forces such coal out of the hopper into the fire box and grate. A fan to affect a forced draft upwardly through the grate to enhance burning is also provided.

While the Baker coal feed mechanism is suitable for its particular purposes, a drawback is that although the reciprocating plate stroke length can be varied to regulate at least somewhat the amount of coal being pushed into the fire box, and therefore the amount of heat produced, in order to adjust the linear distance the reciprocating plate moves, the position of the adjustable stop must be manually rotated either clockwise or counterclockwise on the threaded rod. Such manual adjustment procedure is limiting as well as inconvenient in today's modern society, since, for example, a homeowner may wish to decrease the amount of heat generated during daytime hours when no one is home, and then automatically increase the heat during morning or evening hours, which is not possible where only manual adjustment is achievable. Further, in order for a stoker-fed coal furnace to operate properly, there must be a sufficient fire in the furnace at all times to ensure combustion of the additional coal supplied by the stoker. It is known in other prior art coal stoker arrangements to additionally provide a thermostat or other temperature sensing device to automatically turn the power to the stoker motor on and off, thereby regulating the amount of coal burned and heat generated. A thermostat can also be used to activate the stoker at sufficiently short intervals to ensure that additional fuel will be called for before the fire has reached so low a level as not to be capable of igniting the fresh fuel. However, this frequently does not provide for sufficient regulation of room temperature, and is generally undesirable and ineffective particularly for relatively single stoker systems for coal stove-type devices and the like.

The present inventor, recognizing the limitations inherent in previous coal stoker equipment, has devised a surprisingly efficient and effective arrangement for periodically adjusting or regulating the distance a linearly reciprocating plate such as those used in the Baker type stoker feeding mechanisms travels, which provides significantly improved thermostatic control of the amount of fuel that is forced into the fire box and also as a result the temperature of a room or interior building space. The present invention can also be used with other types of mechanical stoker systems wherein a mechanical reciprocating pusher is utilized. For example, U.S. Pat. No. 4,662,290 issued to Potts entitled "Automatic Coal Stoker" discloses a pusher assembly having a slidingly reciprocating rectangular box configuration with a cam inside, wherein rotation of a cam imparts a reciprocal sliding motion to a pusher assembly. The present invention can also be used to automatically regulate the operation of the Potts coal stoker, rather than having to manually turn the stroke adjusting screw or change the size of the cam. U.S. Pat. No. 6,647,091 issued to Somers entitled "Automatic Coal Stoker" is an example of another similar assembly but having a substantially horizontal fire grate with which the present invention can also be utilized.

OBJECTS OF THE INVENTION

It is therefore an object of the present invention to provide a feeder mechanism capable of allowing automatic and external adjustments for the amount of a fuel such as coal that is fed into a stoker type furnace or boiler utilizing a linearly reciprocating plate to enhance the gravity flow of coal to said furnace.

It is a further object of the present invention to provide a device for automatically adjusting the linear distance said reciprocating plate moves at least temporarily, allowing the amount of fuel being fed onto a fire grate to be increased to regulate the temperature in an area.

It is a further object of the present invention to provide a thermostat control for temporarily varying the stroke length of a linearly reciprocating plate type stoker furnace mechanism.

It is a still further object of the present invention to provide a system for automatically varying the amount of fuel being fed into a furnace by a stoker device by at least temporarily adjusting the linear distance a reciprocating plate forming part of the feeding mechanism of the stoker device slidingly moves on the floor of a coal bin.

It is a still further object of the present invention to provide a thermostatic control for a coal feed mechanism that can be retrofitted into existing coal burning furnaces and boilers.

It is a still further object of the present invention to provide a relatively simple yet effective means for increasing the effectiveness and control of operations of a linearly operable stoker mechanism for feeding fuel in a stoker type coal stove or furnace feed which provides additional adjustability of response at predetermined times.

Still other objects and advantages of the invention will become clear upon review of the following detailed description in conjunction with the appended drawings.

SUMMARY OF THE INVENTION

The operation of a manually adjustable sliding plate type motor stoker is improved by the use of a simple temperature or time indexed adjustment for the sliding plate induced by moving a solenoid arm into the path of movement of an adjustment mechanism for the sliding plate movement indexer so as to in effect lengthen the path of movement of the sliding plate feeder mechanism, thereby feeding relatively more coal into the burning grate by the length and path of movement of the sliding feed plate.

BRIEF DESCRIPTION OF THE APPENDED DRAWINGS

FIG. 1 delineated as prior art is a sectional view from the side of a prior art stoker arrangement.

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention is directed to an improvement in an automatic coal stoker device of a type having a pusher assembly in which a linearly reciprocating panel is positioned overlying the bottom wall or floor of the coal hopper, as well as related arrangements. The reciprocating panel is connected to a motorized rod which when activated effects such linear reciprocating motion. The back and forth movement of the panel causes coal to be pushed out of the hopper by the forward edge of the panel into the furnace or coal burning area at a uniform rate. The rearward edge of the reciprocating panel extends out of the hopper through a slot in a sidewall of the coal hopper, and a shoulder member on the rearward edge of the panel which serves as a pusher bar has an aperture through which the end of the motorized rod extends. Adjustable stops on the rod are positioned on opposite sides of the shoulder member, which stops alternatingly engage against the side surfaces of the shoulder as the rod reciprocates, pushing the panel slidingly outwardly on the coal hopper floor and then inwardly again a predetermined distance. Such basic arrangement is described in U.S. Pat. No. 4,537,140 issued to Baker heretofore described, the entirety of which is hereby incorporated by reference. The present inventor has now developed a control device which is preferably used in combination with a thermostat system with such coal stoking mechanism whereby the distance the linearly reciprocating panel moves back and forth on the floor of the coal hopper can be automatically adjusted. Such automatic adjustment allows for substantially improved automatic control or regulation of the temperature in a room, building space, or the like by temporarily increasing or decreasing the amount of coal that is pushed into the furnace burning area by the coal stoker, thereby regulating the amount of heat produced by the stove. The present inventor's system comprises a substantial improvement over prior art systems such as shown in Baker, wherein the only way to regulate the movement of the panel was to manually adjust the position of the stops on the reciprocating rod, which is inconvenient at best and impractical where the user wishes to automatically regulate the temperature during different parts or the day, or in response to natural changes in the outdoor or atmospheric temperature.

Figure 1:
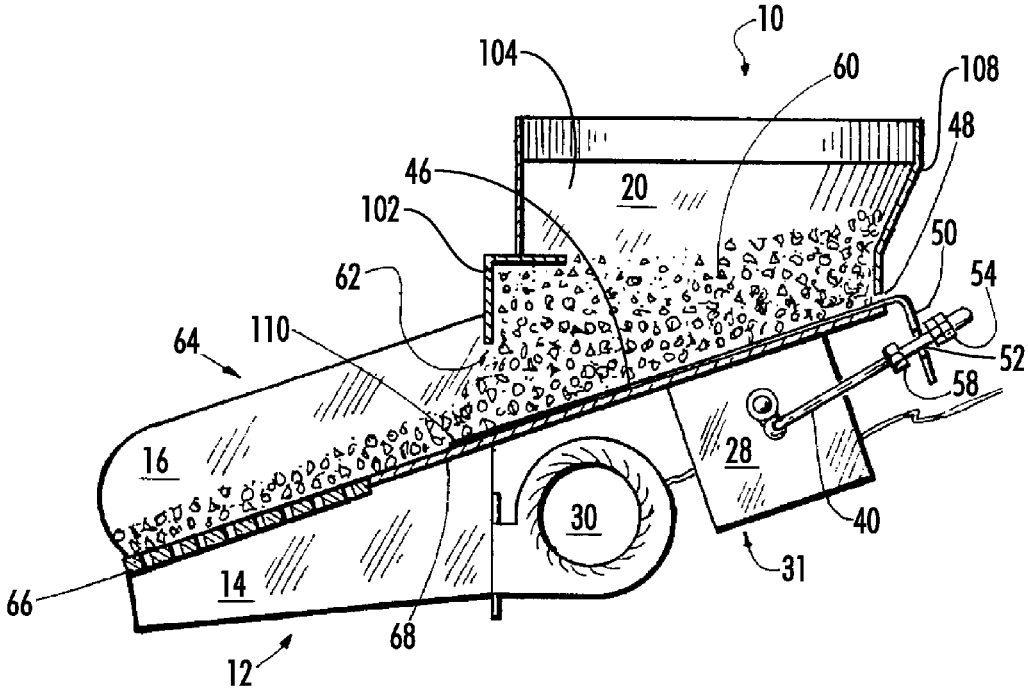
FIG. 1 (PRIOR ART)
Figure 2:
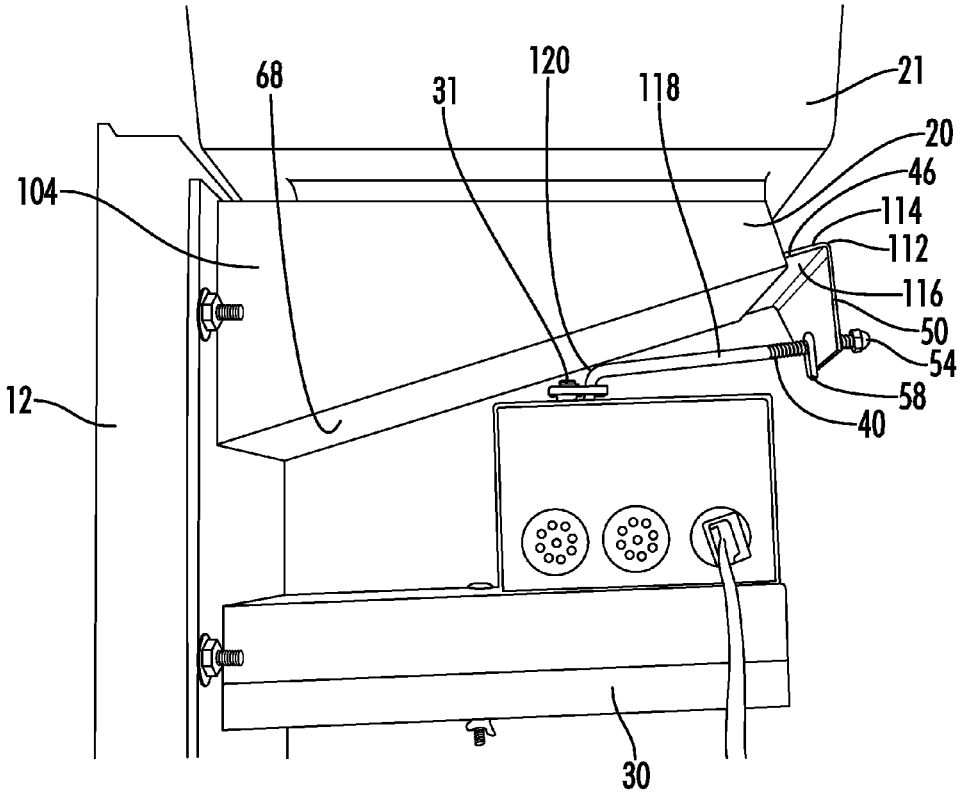
FIG. 2 is a side view of a stoker arrangement of a type used with the present invention.

FIG. 1 illustrates the prior art mechanical coal stoker assembly of Baker, FIG. 2 illustrates a related arrangement that is closely similar to Baker with some minor modifications, FIGS. 3-7 illustrate a preferred embodiment of the present inventor's coal stoker system and assembly, and FIGS. 8-13 illustrate another preferred embodiment of the present invention. In the several illustrated embodiments, wherever possible, like reference numerals have been used to denote like elements or like functional means. In addition, certain elements referred to in the embodiment shown in FIGS. 2-6 may be illustrated in the embodiment shown in FIG. 1, which is a sectional side view of a conventional stoker, and is generally referred to by reference number 10. Stoker assembly 10 includes a fire box or furnace 12 having downwardly sloping or inclined sidewalls 14 and supporting ramp sidewalls 16, and a hopper 20 typically made of sheet metal, which is connected to the rear surface of a fire box or furnace 12, partially shown. Hopper 20 has a downwardly sloping or inclined bottom wall or floor 68 which joins with a perforated fire grate in furnace 12, and as described in greater detail below has appropriate sidewalls, a front wall, and a rear wall. A bin having a lid with a handle, not shown, is normally positioned on the open top of the hopper 20 and holds a supply of coal which is automatically fed into hopper 20 by gravity as coal in hopper 20 is passed into furnace 12 through restricted passage 62 in front side wall 102.

As indicated above, floor 68 of hopper 20 is inclined downwardly towards furnace 12, and extends inwardly into furnace 12 somewhat, and is directly adjacent a fire grate 66 which at least initially is positioned at the same downward slant or angle as floor 68 to allow for an even flow of coal from hopper 20 into furnace 12. A fan or blower 30 is provided to pass a continual flow of air into the furnace to aid in the combustion process, which fan is connected to a motor, not shown.

Figure 12:
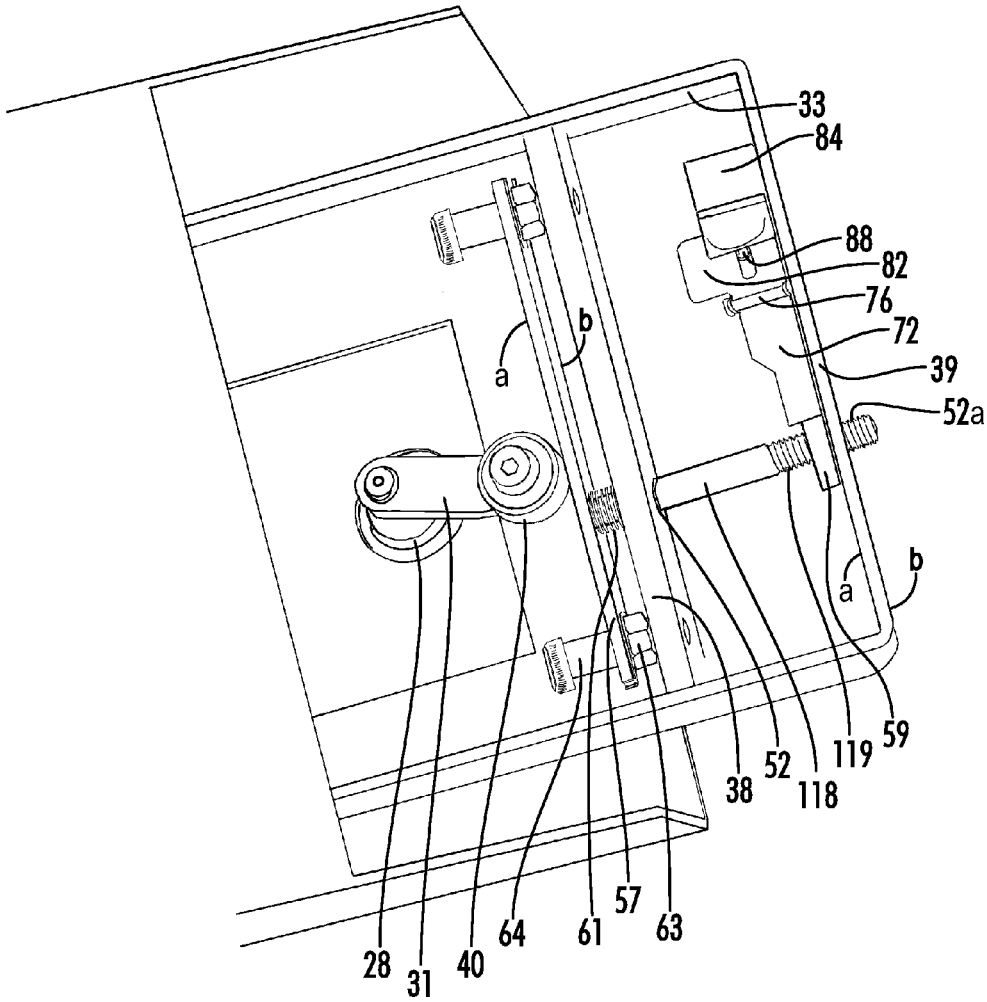
FIG. 12 is a further view similar to FIG. 11 in which the spacer bar of the control system is in a first, nondeployed position.

A flat pusher plate 46 is positioned resting on floor 68 of hopper 20, which plate is preferably made of sheet steel. Pusher plate 46 has a leading edge 110 and as shown in FIG. 12 a rearward edge 112, as well as a top surface 41 on which coal in hopper 20 rests, and a bottom surface 42 which is flush against floor 68 of hopper 20. The rearward edge 112 of plate 46 extends out of hopper 20 through slot 48 in rear wall 108 of the hopper 20. Shoulder or angled section 50 extends downwardly from the rearward edge 112 of plate 46, and there is an aperture 52 provided in shoulder 50 through which, as explained in greater detail below, the distal end of threaded rod 40 is passed.

As shown in FIG. 2, threaded rod 40 has an elongated section 118 and a shorter angled section 120, which shorter angled section 120 is connected to a motor 28 by linkage assembly 31. Linkage assembly 31 forms essentially a reciprocating mechanism which is coupled to motor 28 and adapted for converting rotational motion provided by the motor 28 into reciprocating linear motion, and as shown linkage assembly 31 is cam-type connector wherein as said cam connector is moved in an endless path the elongated section 118 of rod 40 is caused to reciprocate linearly. It will be understood that numerous mechanisms known to those skilled in the art for converting rotary motion of a motor into a reciprocating motion may be substituted for the presently described linkage assembly. Linear reciprocating movement of the elongated section 118 of threaded rod 40 urges the outer or distal end of elongated section 118 linearly back and forth through aperture 52 in shoulder or pusher plate 50 of reciprocating plate 46. An end stop 54 is provided on the outer end of elongated section 118, while a threadably adjustable stop 58 is provided on elongated section 118 of rod 40 at a position inwardly of the inner surface 122 of shoulder member 50, and which stops 54 and 58 are dimensioned so that they cannot pass through aperture 52. Adjustable stop 58 in FIG. 2 has a handle section which due to gravity hangs downwardly on the threads of elongated rod section 118, preventing the stop from rotating on such threads.

Reciprocating movement of elongated section 118 of rod 40 caused by motor 28 includes an outbound stroke and an inbound stroke. During the outbound stroke, section 118 of rod 40 moves outwardly until at some point depending on the position of stop 58, the outer surface of such stop 58 will press against the inner surface 122 of shoulder member 50. Continued movement of rod section 118 in an outbound direction causes stop 58 to push shoulder member 50 outwardly, and as a result also pushes plate 46 on the floor 68 of hopper 20 outwardly or away from furnace 12. Such outward movement creates a space in hopper 20 forward of the leading edge 110 of plate 46, which space is quickly filled by coal in hopper 20 falling or moving downwardly by the downward force of gravity as well as the forwardly inclined angle of bottom surface or floor 68 of hopper 20, filling such space.

Eventually, rod section 118 of rod 40 will finish its outward stroke and begin its return or inward stroke, and at some point depending on how far outwardly shoulder member 50 and plate 46 are pushed, end stop 54 will engage against the outer surface of shoulder or pusher plate 50. This in turn causes panel 46 to also be pushed forwardly towards furnace 12 on the floor 68 of hopper 20, which movement will push coal that has filled the space in front of the leading edge 110 of panel 46 into furnace 12, where it is burned for heat. At certain points between rod 40 completing its outward stroke and starting its inward stroke, panel 46 will remain motionless until rod section 118 and end stop 54 are moved far enough inwardly again to come into contact with the outer surface of shoulder 50. Similarly, upon completion of the inward stroke panel 46 will remain motionless at a full inward position until the reciprocating motion of rod 40 has reversed and has once again traveled outwardly a sufficient distance for adjustable stop 58 to again press against the inner surface 122 of shoulder 50, where the outward motion of plate 46 is repeated.

The distance that panel 46 is pushed outwardly can be varied manually simply by turning and adjusting the position of adjustable stop 58 on the threads of elongated rod section 118 of rod 40. For example, rotating stop 58 in a counterclockwise direction when viewed from end stop 54 will move it farther away from shoulder 50 connected to plate 46, which will cause such stop 58 to contact the inner surface 122 of shoulder member 50 at a later time upon each outward stroke of rod section 118, and as a result, stop 58 will be engaged against inner surface 122 of shoulder member 50 for a shorter time period and move plate 46 on the floor 68 of hopper 20 a shorter distance. The shorter the distance that plate 46 is moved outwardly, the less room or space is created along the leading edge 110 of the plate 46 for coal to fill, so that on the return or inward stroke, less fuel is subsequently pushed by leading edge 110 into the furnace. Alternatively, if stop 58 is rotated in a clockwise direction when viewed from end stop 54, upon each outbound stroke of rod section 118, stop 58 will contact the inner surface 122 of shoulder member 50 sooner, and thus will push plate 46 outwardly a greater distance, leaving more space along the leading edge 110 of panel 46 in hopper 20 for coal to fill, which greater amount of coal will be pushed into furnace 12 on the return stroke, causing the stove to emit more heat.

As indicated, FIGS. 1-2 illustrate the basic type of stoker arrangement from which the present invention is designed as an improvement and can be readily adapted to use therewith. However, the Baker type furnace has spawned a number of variations based upon the same basic mechanical arrangements and the present applicant has chosen to use some of such later variations for illustration of his invention.

As discussed above, the stoker assembly includes a coal hopper 20 typically made of sheet metal, which is connected to the rear surface of a fire box or furnace 12, partially shown. More particularly, hopper 20 has a front wall 102, sidewalls 104, and a rear wall 108, and a downwardly sloping or inclined floor 68 which abuts end to end with perforated fire grate 66 in furnace 12. Bin 21 (see FIG. 2) is positioned on the open top of hopper 20 and holds a supply of coal which by force of gravity is automatically fed into hopper 20 as coal in hopper 20 passes into furnace 12 through passage 62 in front wall 102. Downwardly inclined floor 68 of hopper 20 extends inwardly into furnace 12 to grate 66, which grate 66 at least initially has the same downward slant or angle to allow for an even flow of coal from hopper 20 into furnace 12. Fan or blower 30 is connected to a motor 28, which motor may be an electrical motor, and passes a continual flow of air across grate 66 in furnace 12 to aid in the combustion process.

Flat pusher or reciprocating plate 46 is positioned resting on floor 68 of hopper 20, which plate 46 is preferably made of sheet steel. Plate 46 has a forward or leading edge 110 (see FIG. 1) and a rearward edge 112 (see FIG. 2), as well as a top surface 114 on which coal in hopper 20 rests, and a bottom surface 116 which is flush against floor 68 of hopper 20. The rearward edge 112 of plate 46 extends out of hopper 20 through slot 48 in rear wall 24 (see FIG. 1). Angled shoulder or pusher plate 50 extends downwardly from rearward edge 112 of plate 46, and an aperture 52 is provided in angled plate 50, through which, as will be explained in greater detail below, the distal end of threaded rod 40 is passed.

Referring now in particular to FIGS. 3-6, there is shown a thermostat control system 70 for automatically adjusting the distance plate 46 is moved outwardly during the outbound stroke of motorized reciprocating rod 40. System 70 provides users with significantly greater and easier control of the amount of heat being produced by devices such as coal stoker device 10 during any given time period, thus increasing the user's selective control over the temperature in a room, home, or other indoor area in which the coal stove is located. The inventor accomplishes this by providing a thermostatically controlled arm or spacer bar 72, which is selectively inserted in the space between the outer surface 126 of threaded stop 58 and the inner surface 122 of angled plate 50. This in effect lengthens the setting of the stop 58 and lengthens the stroke of the plate 46 and the distance such plate is moved outwardly, allowing more coal to be dropped in front of it from the hopper and increasing the feed of coal into the system on the backstroke.

Figure 3:
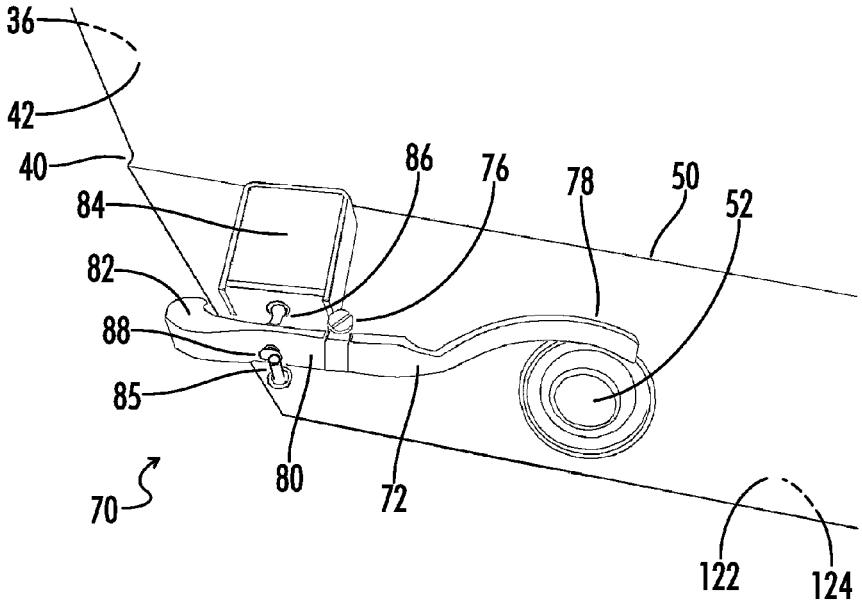
FIG. 3 is a partial isometric view of the control system for use with the coal stoker arrangement shown in FIG. 2.

Referring now to FIG. 3, there is shown a portion of the underside 116 of plate 46, and of the inner surface 122 of downwardly disposed angled plate 50 connected to the rearward edge 112 of plate 46, and showing aperture 52 in angled plate 50. Spacer bar 72 has a curved blade section 78 and a flat section 80, and is pivotally mounted to the inner surface 122 of angled plate 50 on pivot member 76. Spacer bar 72 is aligned so that in a first pivoted position, blade section 78 is pivoted upwardly or away from aperture 52 (see FIG. 4), and in a second pivoted position blade section 78 is disposed in close proximity to or in front of aperture 52 (see FIG. 5). Flat section 80 of spacer bar 72 extends outwardly in the opposite direction from blade 78, and a counterweight 82 is provided on the outer end of flat section 80.

Figure 4:
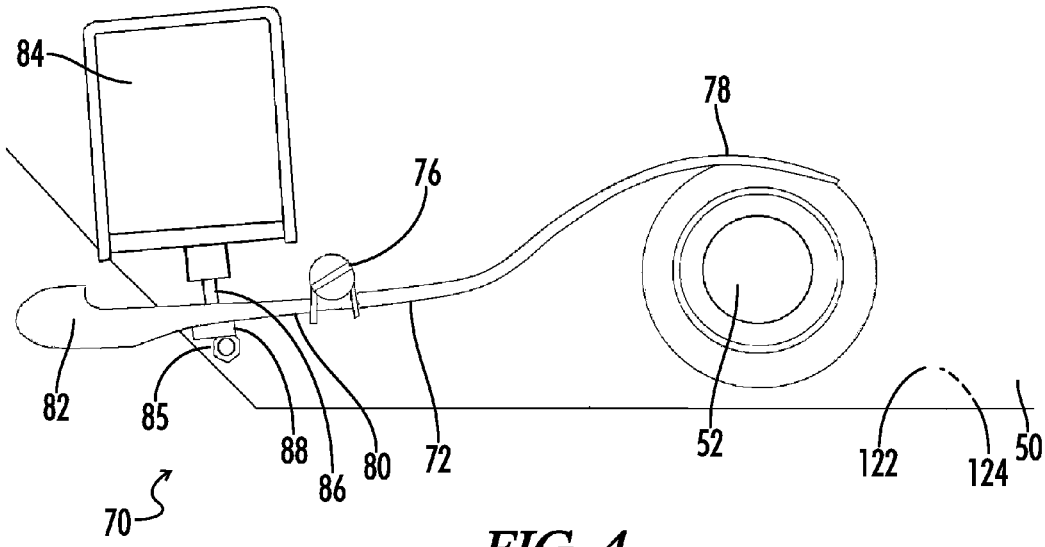
FIG. 4 is a partial side view of the control system shown in FIG. 2 with the spacer bar in a first pivoted position.
Figure 5:
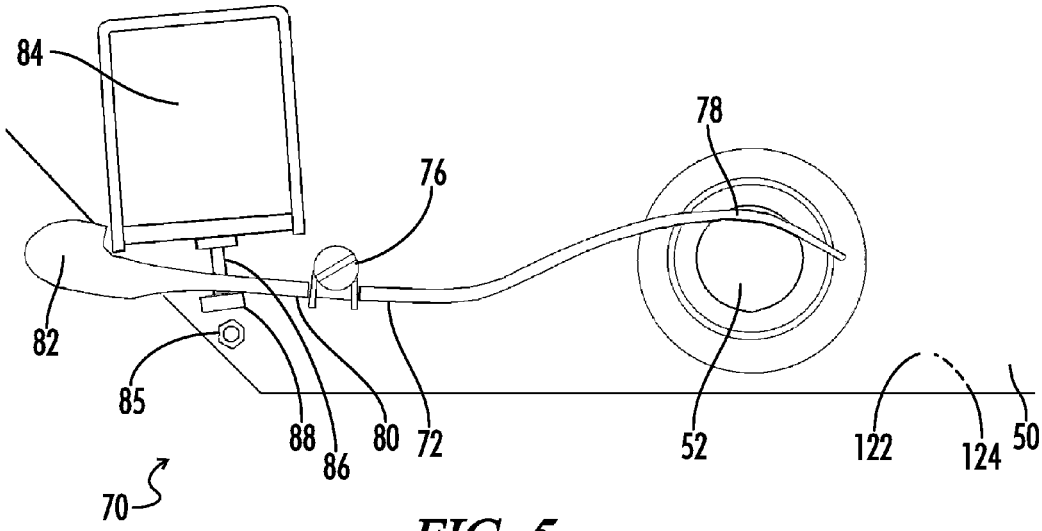
FIG. 5 is a partial side view of the control system shown in FIGS. 2 and 3 with the spacer bar in a second pivoted position.

In addition, a small electric solenoid 84 is mounted to the inner surface 122 of angled plate 50 in a conventional manner such as by screws, straps, or the like, in a position adjacent flat section 80 of spacer bar 72. A plunger 86 extends through an orifice in the side surface of flat section 80 of spacer bar 72, where it is secured by plunger head 88. In addition, a stop 85 is positioned under head 88, which as explained below prevents spacer bar 72 from pivoting beyond a predetermined angle in the first pivoted position shown in FIG. 4. Solenoid 84 is of a type well known in the prior art for converting electrical energy into linear motion. A suitable commercially available solenoid for use with the present invention would be a small size, open frame solenoid of a type having a plunger weight of 2.4 grams and a total weight of 18 grams, dimensions of 24 millimeters by 16 millimeters by 13 millimeters, and power consumption during continuous use of 1.6 watts, operating with 6 volts. However, the above specifications should not be considered limiting, and solenoids having other specifications or linear or rotary solenoids may be utilized with the present invention. Plunger 86 is pulled upwardly towards solenoid 84 when the solenoid is energized, and is released when the solenoid is deenergized. As illustrated in FIGS. 3 and 4, solenoid 84 is in a deenergized state, so that plunger 86 is extended from solenoid 84. Spacer bar 72 is mounted on pivot 76 so that counterweight 82 will cause spacer bar 72 to pivot into said first pivoted position, wherein as shown in FIGS. 3 and 4 blade section 78 of spacer bar 72 is pivoted upwardly away from aperture 52. However, as illustrated in FIG. 5, when electric solenoid 84 is energized, plunger 86 is pulled inwardly towards the solenoid so that plunger head 88 is no longer resting on stop 85, and which movement causes flat section 80 of spacer arm 72 to be pivoted upwardly on pivot 76, while blade section 78 of spacer arm 72 pivots downwardly so the blade section 78 is in front of at least a portion of aperture 52.

Figure 6:
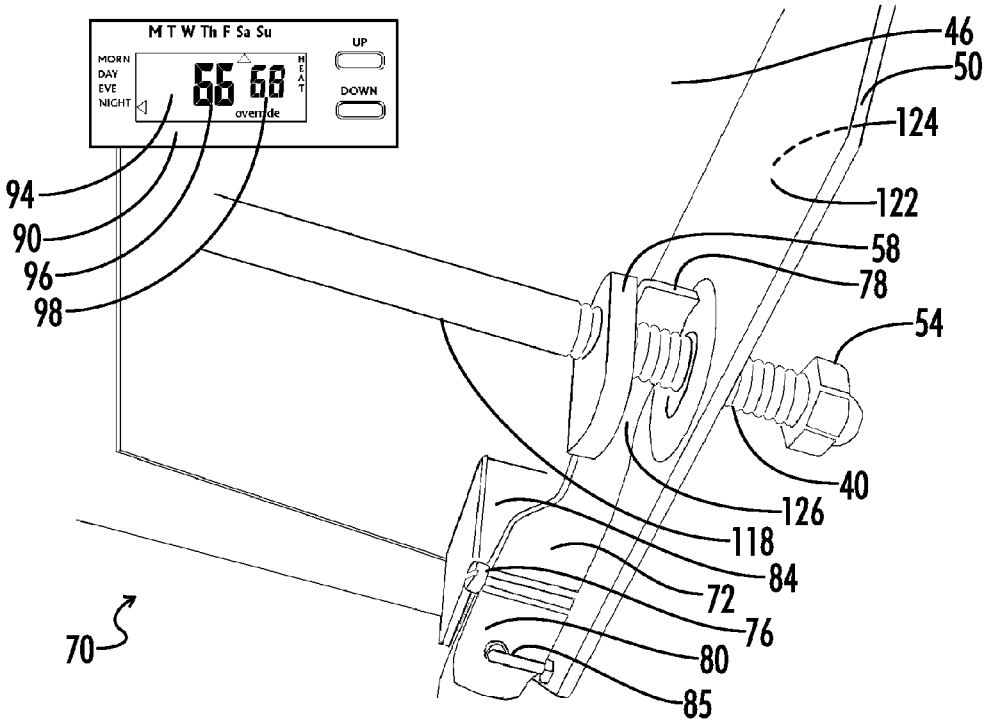
FIG. 6 is a partial isometric view of the control system in combination with the reciprocating rod assembly and illustrative thermostat control.

As best shown in FIG. 6, system 70 also includes a thermostat control 90, which is operably connected to solenoid 84 in a known manner, such as by a hardwire connection or a wireless controller, and is used to selectively energize the solenoid. Thermostat 90 includes a display area 94, on which in the example shown in FIG. 6 the room temperature 96 is indicated as being 66 degrees, while the desired temperature 98 indicated is 68 degrees. In such circumstance, it is desired to increase the amount of heat being produced by furnace 12 to raise the room temperature from 66 degrees to 68 degrees, and therefore the amount of coal being introduced into furnace 12 must be increased at least temporarily until the desired room temperature is reached. In order to increase the amount of coal being introduced into furnace 12, the distance plate 46 is moved outwardly of coal hopper 20 must be increased. While in previous arrangements described above, this could only be accomplished by adjusting the position of stop 58 by use of a manual operation or by some complicated mechanical arrangement, through use of the present inventor's thermostat control system 70, this is accomplished simply and effectively by having blade section 78 of spacer bar 72 pivot downwardly into a second pivoted position so that blade section 78 is interposed between the outer or forward facing surface 126 of adjustable stop 58 and the inner surface 122 of angle blade 50. Thus, when as shown in FIG. 6 reciprocating rod section 118 of rod 40 moves in an outbound stroke in a manner that has already been described, blade section 78 of spacer bar 72 will be wedged in-between stop 58 and the angled plate 50, in effect causing stop 58 to commence pushing against inner surface 122 angled plate 50 earlier than otherwise, causing plate 46 in hopper 20 to start moving outwardly sooner during such outbound stroke, and as a result pushing plate 46 a further distance rearwardly out of hopper 20. Spacer bar 72 is thus automatically pivoted into such position when solenoid 84 is energized, which energization takes place whenever the set temperature 98 of thermostat control 90 is greater than the room temperature 96.

In effect, therefore, by temporarily inserting blade section 78 of spacer bar 72 between stop 58 and the inner surface 122 of angled plate 50, the linear distance or stroke length of the device is increased automatically. As should now be evident, insertion of blade section 78 between stop 58 and angled plate 50 causes reciprocating plate 46 to move a greater distance out of coal hopper 20, thereby allowing more coal to fall downwardly into the space created along the leading edge 110 (see FIG. 1) of plate 46, and then upon an inbound stroke forcing more coal into furnace 12 and generating more heat.

Figure 7:
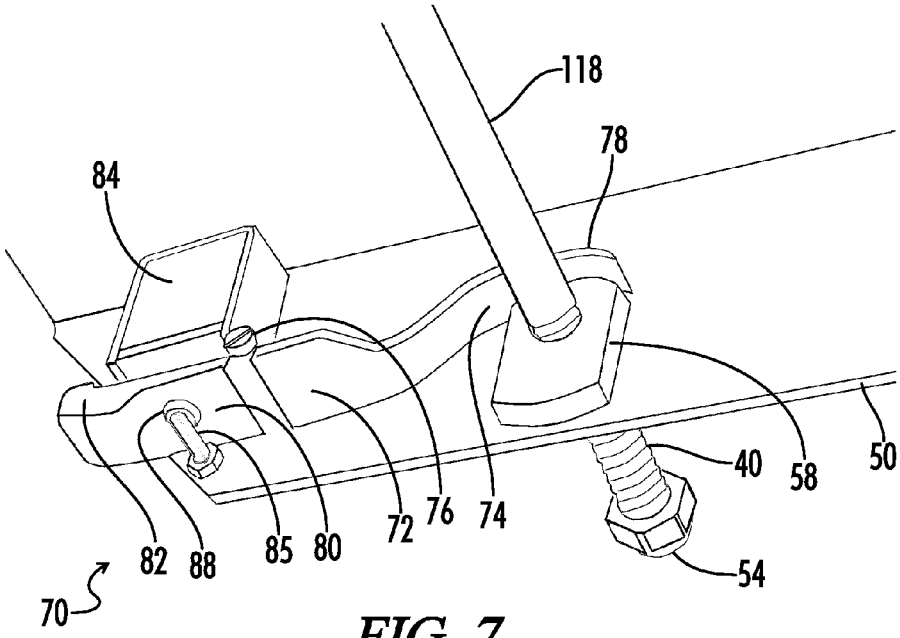
FIG. 7 is a partial isometric view of the control system and reciprocating rod assembly with the spacer bar in the first pivoted position shown in FIG. 4 and the reciprocating rod moved so that the adjustable stop is adjacent the inner surface of the plate angled shoulder section.

Once the actual temperature 96 in the room or other interior environment rises to the set temperature 98, thermostat control 90 will automatically deenergize solenoid 84, allowing blade section 78 of spacer bar 72 to pivot upwardly due to counterweight 82 so that it no longer is situated between stop 58 and angled plate 50. Thus, as shown in FIG. 7, upon the next outbound movement of elongated rod section 118, plate 46 will not commence moving outwardly until stop 58 abuts directly against inner surface 122 of angled plate 50, and thus the stroke length or distance plate 46 is moved outwardly will be decreased to the original setting.

It will be evident from the above that thermostat control system 70 of the present invention comprises a substantial advance over the prior art system described with particular reference to FIGS. 1 and 2, wherein in order to adjust the stroke length of the stoker device, the position of stop 58 must be manually adjusted by rotating the stop in either a clockwise or counterclockwise direction on rod 40. In the present arrangement, however, it is not necessary to manually adjust the position of stop 58, since if the heat energy is to be increased, the user will simply utilize the thermostat control 90 accordingly so that solenoid 84 is energized to cause spacer bar 72 to pivot so that blade section 78 is between stop 58 and the inner surface 122 of angled blade 50 attached to plate 46. It should also be evident that the width of blade section 78 may be varied accordingly, so that if blade 78 is wider it will be contacted by stop 58 sooner than if blade Th is narrower. In addition, the position of stop 58 may also still be manually adjusted to different base or standard positions, as may be desired to set a base heat level. For example, if a lower base temperature is desired, stop 58 may be turned or rotated clockwise from the perspective of stop 54, or if a higher base temperature is desired, stop 58 may be turned or rotated counterclockwise from the perspective of stop 54. The combination of adjustable stop 58 and the thermostat control system 70 allows for automatic and therefore significantly greater precision and control over the amount of fuel being introduced into coal stoker assembly 10 and as a result the amount of heat being produced and therefore the room temperature. Using thermostat control system 70, the device can be programmed to automatically increase the stroke length of plate 46 at different times of the day, or simply to maintain the room or environment at a constant temperature as the atmospheric or outside temperature rises and falls, at least within a reasonable range.

Other reciprocating coal feeder mechanisms based on the Baker model whereby the reciprocating movements are produced in more than one way have been devised and are still in operation. A reciprocating movement is used for a variety of coal and pellet stoves, mostly following the same idea of having either a crank, producing the back and forth movement, or a concentric cylinder, or a rotating cam with a cam follower mechanism to produce the movement as well, and some newer models resort to having a windshield wiper like arrangement to produce an angular rather than a linear reciprocating movement. All movements mentioned herewith, still rely on either a manual adjustment to vary the stroke length of a travel distance, or on shutting off the motor and have wait time between cycles.

Figure 8:
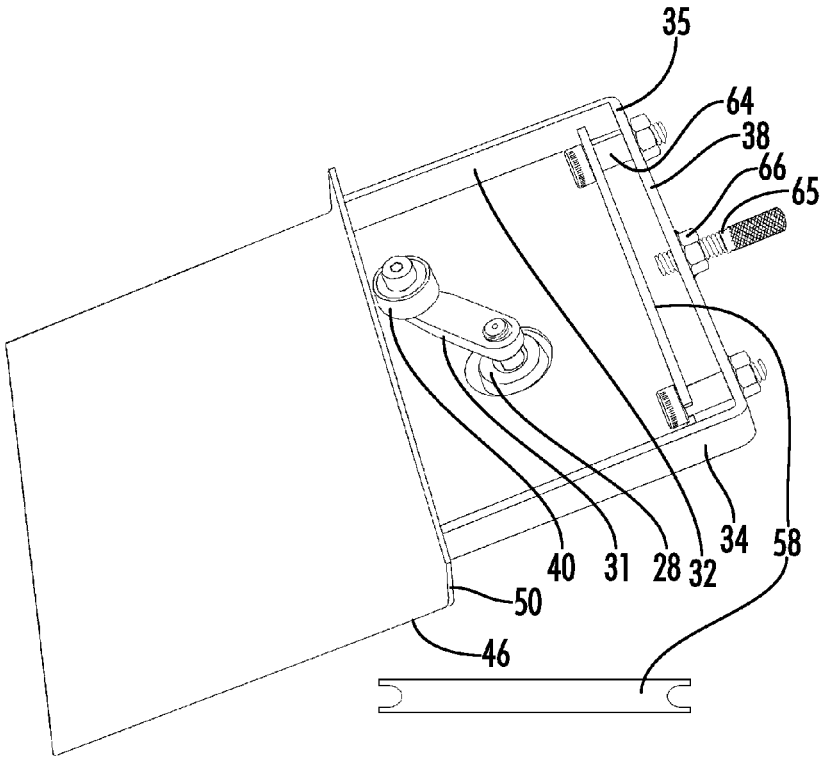
FIG. 8 is an oblique drawing of the operating mechanism of a further type of sliding plate mechanism.
Figure 9:
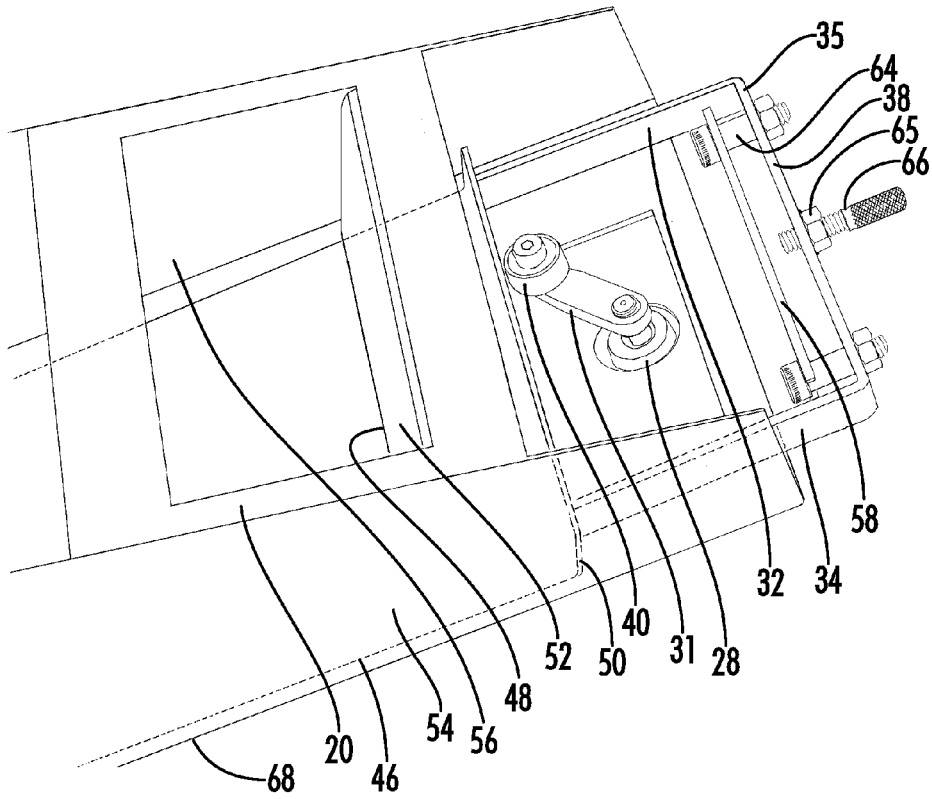
FIG. 9 is an oblique more complete view of the portion of the apparatus show in FIG. 8 but also showing the sides of the hopper plus the opening in the top through which the coal drops into such hopper.
Figure 10:
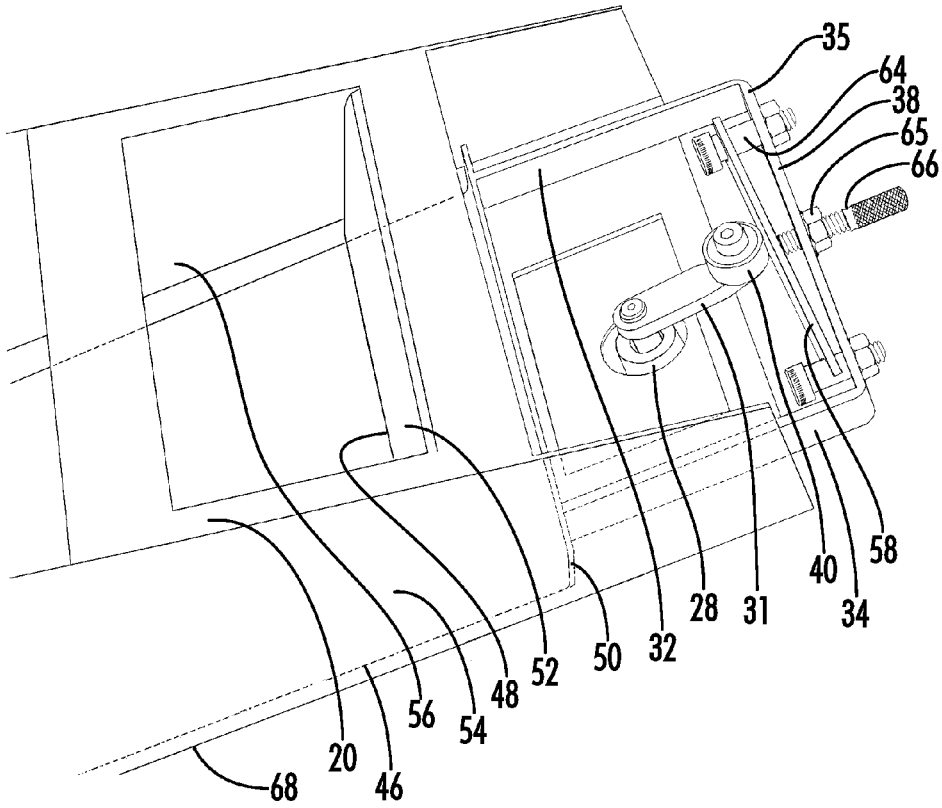
FIG. 10 is an oblique view similar to FIG. 9 in which the rotatable arm has turned further and is displacing the stop which has been started in its outward movement by the set screw.

One such other arrangement is shown generally in FIG. 8 and more fully in FIGS. 9-10. As in the previously described arrangement, a reciprocating plate 46 is situated on the top surface of downwardly sloping floor 68 of hopper 20, with one end projecting through transverse slit 48 in the rearward end of hopper 20, and with perpendicular or radially projecting plate 50 on the end of reciprocating plate 46, which in the presently described embodiment is disposed in the upward direction. Bracket 35 is made up of side sections 32 and 34 joined on one end by cross section 38, while the other ends of side sections 32 and 34 are welded to the back of perpendicular plate 50 extending outwardly therefrom to form a rectangular shape. In the present embodiment, plate 50 serves more than one function. Plate 50 prevents reciprocating plate 46 from sliding all the way down floor 68, by abutting against plate 52 (see FIG. 9) at the rear side of the hopper 20. In addition, as explained in further detail below, plate 50 serves as the contacting surface for pushing reciprocating plate 46 during the dump stroke of the cycle by the bearing or the cam follower 40 attached at the end of crank arm 31 pivoting around the reduction gears point, at about 1 RPM, powered by motor 28.

Plate 46 is moved in a reciprocating linear movement by the rotation of the crank arm 31 pivoting around the reduction gears point produced by motor 28, and by having bearing or cam follower 40 engage alternatingly against the back side of plate 50 and movable and adjustable stop 57, respectively, which stop 57 is secured to end section 38 of bracket 35 by sliding guides 64 made up of either shoulder bolts or other metal studs. Adjustable stop 57 has cutout sections on its ends which engage with sliding guides 64 so that stop 57 is free to slide along sliding guides 64. Rotation of crank arm 41 causes plate 46 to be slidingly pushed and pulled back and forth on floor 68 of hopper 20, with a pause in such a sliding movement of plate 46 for the duration of movement of bearing 40 between plate 50 and adjustable stop 57. As plate 46 moves rearwardly, coal in hopper 20 falls downwardly onto floor 68 in front of plate 46, and when the plate again is moved forwardly the leading edge of plate 46 forces such coal to be advanced out of hopper 20 onto a grate (not shown).

As with the arrangement shown in FIGS. 1-7, the amount of coal falling in front of plate 46 is dependant on the rearward travel distance of plate 46, which is determined by the point at which hand adjusted screw 66 sets against the adjustable stop 57. End section 38 of rectangular bracket 35 has a drilled hole (not shown) at a central location, and a welded nut 65 is provided on the outer surface of end section 38 of bracket 35 surrounding such hole, with the hole having a slightly bigger diameter than the diameter of welded nut 65 and aligned as such to allow adjustment screw 66 to be secured on the threads of nut 65 and travel freely through end section 38. Alternatively, as will be evident to those skilled in the art, the drilled hole may be threaded to receive screw 66. When adjustment screw 66 is set inward (closer) to adjustable stop 57, the time duration along with initial contact distance between bearing 40 and adjustable stop 57 with adjustment screw 66 is shortened, therefore causing plate 46 to travel backward a longer distance, and allowing more coal to drop from hopper 20 ahead of plate 46.

As will be evident in FIG. 9, as the rotatable arm 31 rotates in either a clockwise or counterclockwise direction, it will at one point in its travel press against the outer surface of perpendicular plate 50, forcing the plate 46 toward the grate and in turn pushing coal into the fire. In addition, as best shown in FIG. 10, at another point when the arm 31 presses on the stop 57 it will be forced against the head of adjustment screw 66 which is manually adjustable to determine the distance to which the plate 46 will be pushed back and determines the stroke of plate 46 on the feeding stroke.

Figure 11:
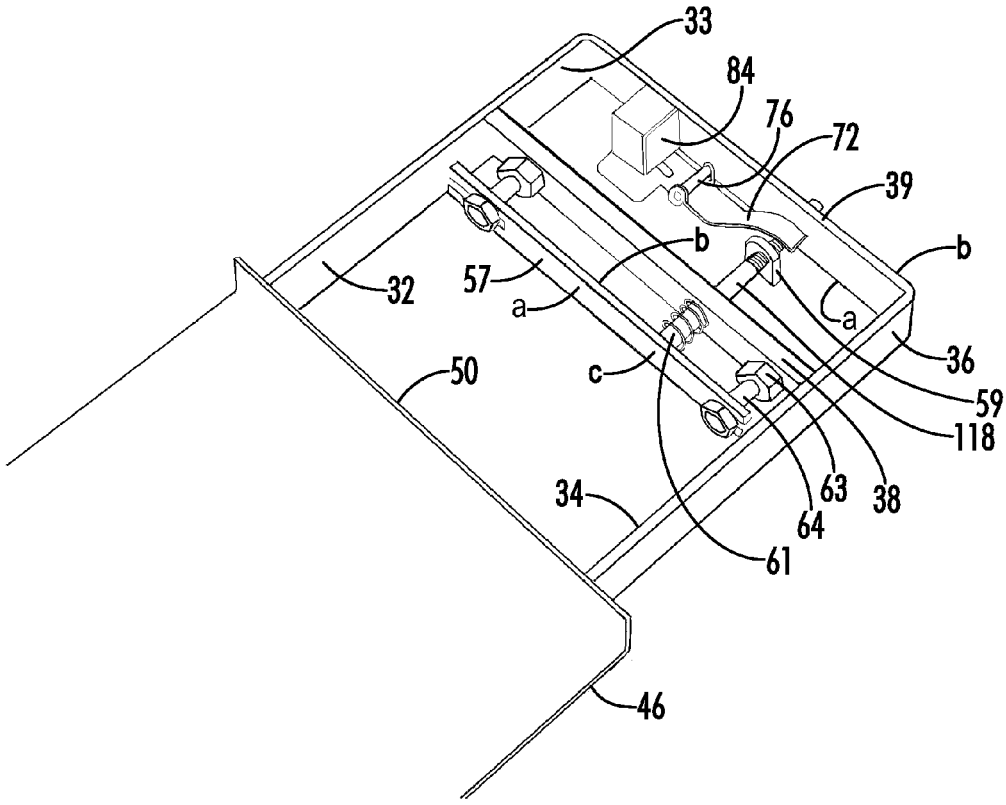
FIG. 11 is a view of an improved arrangement according to the invention in which a setting nut has been provided which is adjustable on a setting rod, and including the solenoid activated spacer bar of the invention.
Figure 13:
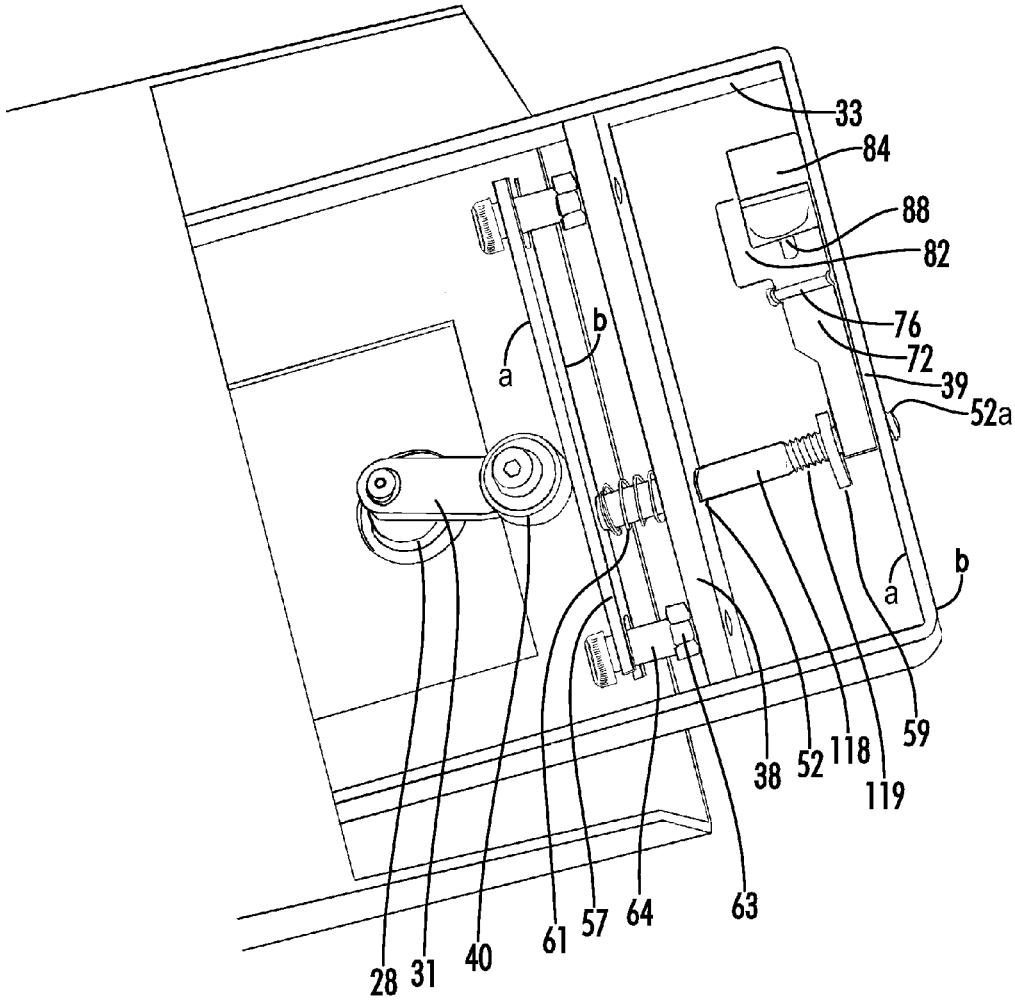
FIG. 13 is further view similar to FIG. 11 in which the spacer bar of the control system is in a second, activated position.

As illustrated in FIGS. 11-13, the present inventor has now made several modifications to the just described system so that a solenoid arrangement such as shown in FIGS. 3, 4 and 5 may be used to block movement of the adjustable stop 57 (see FIG. 11) further toward the member 38 in which the adjustment set screw is mounted, thus causing return movement of the plate 46 to occur sooner and continue for a longer period, with the result being the feeding of more coal to the furnace upon the activation of the solenoid. Without such modifications, the outcome would not be very satisfactory due to imbalance. Such modifications will now be described.

In order to effect the use of a simple solenoid to make extra adjustments in the feeder plate adjustment, the present inventor has added a further outer section to the bracket arrangement shown in FIGS. 8-10. This is best illustrated in FIG. 11, which shows extended side sections 33 and 36 extending outwardly and supporting an outer crossbar 39 having an inwardly facing side "a" and an outwardly facing side "b", and having an aperture 52*a* (see FIGS. 11 and 12) in which a connecting rod 118 is slidably mounted. As will be shown, rod 118 forms an adjustment means for the bar 57 also having an inwardly facing side "a" and an outwardly facing surface "b", against which side "a" the bearing or wheel 40 presses to urge the plate 46 to move outwardly. An adjustable setting nut 59 is provided on the threads of rod 118 between member 38 and outer crossbar 39 which can be moved to various points on the rod 118 to adjust where the rod 118 will be stopped from further outward movement by contact with cross member 39, which in turn will determine how much force will be applied to the stop 57 to pull back the plate 46. Bar 57 is welded to connecting rod 118 at point "c" (see FIG. 11) at a perpendicular angle, and about a third length inwardly from side surface 36 of the bracket. Section 38 is wide enough to allow a drilled hole to act as a guide for the travel of connecting rod 118. Bar 57 is free to slide back and forth along the outer surfaces of pair of shoulder bolts 64. Guide hole 52 of section 38 is in alignment with aperture 52*a* in outer section 39, and the position (point "c") rod 118 is connected to bar 57. A coil spring 61 about the rod 118 between stop 57 and member 38 will tend to press the stop 57 away from member 38 when no force from the rotating arm 31 and bearing or roller 40 is applied to it. When the rod 118 is pressed outwardly, the position of the set nut or stop 59 will determine where the movement will stop or the extent of such movement. This is analogous therefore to the use of the set screw 66 in the earlier drawing figures.

If it is desired to stop the outward movement of the stop 57 earlier, therefore, solenoid 84 which is mounted to the inner surface of cross member 39 as shown in FIG. 11-13 can be used to move the solenoid arm 72 behind the stop 59 before it reaches the cross member 39, which will result in the rotary movement of arm 31 drawing the plate 46 back sooner and attaining a wider feeding range. The rod 118 is positioned eccentrically with respect to the crosswise dimensions of the construction as shown so that the slide rod 118 will be approximately at the contact point of the rotating member with the face of the stop 57. This position is shown in the drawings for a counterclockwise movement of the rotating member. The position would be reversed for a clockwise rotating member. While solenoid 84 is inactive, the weight of plunger 88, combined with counterweight section 82, drops down and causing section 72 of lever to lift up to a position clear of threaded adjustment nut 59. Initial pressure from side "a" of part 57, caused by bearing 40 will force part 57 toward end stop 63, consequently moving connecting rod 118, and threaded adjustment nut 59 toward side "a" of section 39, while compressing spring 61. Movement of section 57 connecting rod 118 through the guide hole of section 38 aperture 52, will stop once section 57 reaches endstop 63, or adjustment nut 59 reaches side "a" of section 39. Any further pressure on side "a" of section 57 will cause the entire assembly to move in the rearward direction.

By the use of the present inventor's development a simple automatic control within limits can be provided to a single normally manually adjustable coal stoking mechanism which allows simple and particular timed adjustments in heat attained to be made. It is further noted that in contrast to prior art coal stoker automatic adjustment arrangements with the present inventor's arrangement the coal stoker motor continues to run while the stroke length adjustment is made automatically. The inventor's control system can be easily adapted for use with other systems wherein it is desired to automatically alter at least temporarily the stroke length of an apparatus moving in a reciprocating motion.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. An automatic adjustment for coal stokers using a reciprocating feed movement of a plate at the bottom of a stoker comprising the use of:

a low power solenoid arrangement mechanism to move a light solenoid arm into the path of a normally manually adjustable setting means to cause a reciprocating movement of a feeding mechanism to have an increased scope.

2. An automatic adjustment arrangement in accordance with claim 1 wherein the interpretation of a solenoid arm causes earlier and extended activation of a moving feed mechanism by earlier contact with a usual setting mechanism.

3. An automatic adjustment arrangement in accordance with claim 1 wherein the stroke length of the reciprocating feed movement can be changed while the coal stoker motor continues to run.

4. An auxiliary control means for altering the range of control of a reciprocating control arm which oscillates between manually adjustable stops comprising:

(a) a reciprocable control arm with at least one manually adjustable stop;

(b) a solenoid provided with a condition responsive detector; and (c) a predetermined width spacer means in operative contact with the solenoid;

(d) whereby when the solenoid is operated the spacer is brought against the reciprocating control arm adjacent to the at least one adjustable stop in order to effectively automatically change the length of oscillation between manual set points on the reciprocating arm.

5. An auxiliary control means in accordance with claim 4 wherein the condition activating the solenoid is temperature in a coal stocker arrangement having a reciprocating feed.

6. An auxiliary control means in accordance with claim 5 wherein the solenoid changes the effective length of the reciprocable control arm between stops by effectively increasing the possible length of movement between stops.

7. An auxiliary control means in accordance with claim 5 wherein the solenoid changes the effective length of the reciprocating control arm between stops by effectively decreasing the effective length of movement between stops.

8. A device for automatically varying the stroke length of a slideable plate type coal stoker assembly having a radially projecting shoulder plate member comprising:

a spacer arm having a blade section and an end section spaced from said blade section, said spacer arm pivotably connectable to said coal stoker assembly and being pivotable between a first position in which the blade section is interposed between stop connected to a rod passing transversely in a reciprocating motion through an aperture in a plate member forming part of the stoker assembly thereby increasing the stroke length of the slideable plate, and a second position in which the blade section is not positioned between the stop and plate member; and means for pivoting the spacer arm between said first and second positions.

9. The device of claim 8 in which said means for pivoting the spacer arm between said first and second positions comprises an electric solenoid device operably connected to said spacer arm.

10. The device of claim 9 additionally comprising a thermostat control operably connected to the solenoid to electrically energize and deenergize said solenoid according to the settings of said control in order to control the position of said spacer arm.

11. The device of claim 10 additionally comprising a shoulder member connected to said slideable plate type coal stoker assembly and having an inner surface and an outer surface, and said spacer bar being pivotably connected to said inner surface.

12. The device of claim 8 in which said means for pivoting the spacer arm between said first and second positions includes a plunger connecting between an electronic solenoid and said spacer arm such that when the solenoid is energized the plunger is pulled inwardly towards the solenoid and the blade section of the spacer arm is moved to said first position.

* * * * *